US005564685A

United States Patent [19]

Reist

[11] Patent Number: 5,564,685

[45] Date of Patent: Oct. 15, 1996

[54] DEVICE FOR THE ADHESIVE STITCHING OF PRINTED PRODUCTS

[75] Inventor: Walter Reist, Hinwil, Switzerland

[73] Assignee: Ferag AG, Hinwil, Switzerland

[21] Appl. No.: 370,841

[22] Filed: Jan. 9, 1995

[30] Foreign Application Priority Data

Jan. 10, 1994 [CH] Switzerland ..... 00061/94

[51] Int. Cl.[6] ..... B42C 9/00

[52] U.S. Cl. ..... 270/52.18; 412/37

[58] Field of Search ..... 412/8, 37, 6, 8, 412/37, 38; 270/37, 52.18

[56] References Cited

U.S. PATENT DOCUMENTS

| | | | |
|---|---|---|---|
| 2,168,547 | 8/1939 | Wood | 270/37 X |
| 3,951,399 | 4/1976 | Reist . | |
| 4,058,202 | 11/1977 | Reist . | |
| 4,398,710 | 8/1983 | Hansch . | |
| 4,408,754 | 10/1983 | Meier . | |
| 4,408,755 | 10/1983 | Meier . | |
| 4,489,930 | 12/1984 | Meier . | |
| 4,684,116 | 8/1987 | Hansch . | |
| 4,684,117 | 8/1987 | Honegger et al. . | |
| 4,706,951 | 11/1987 | Leu . | |
| 4,709,910 | 12/1987 | Honegger . | |
| 4,715,758 | 12/1987 | Stobb | 412/8 |
| 4,723,770 | 2/1988 | Seidel et al. . | |
| 4,735,406 | 4/1988 | Weber . | |
| 4,743,005 | 5/1988 | Reist . | |
| 4,792,077 | 12/1988 | Faltin | 270/37 X |
| 5,052,666 | 10/1991 | Hansch . | |
| 5,052,667 | 10/1991 | Hansch | 270/54 X |
| 5,137,409 | 8/1992 | Honegger | 270/53 X |
| 5,172,897 | 12/1992 | Hansch et al. | 270/53 |
| 5,174,557 | 12/1992 | Meier | 270/52.18 X |
| 5,193,851 | 3/1993 | Honegger . | |
| 5,324,014 | 6/1994 | Honegger et al. | 270/52.18 X |
| 5,342,032 | 8/1994 | Meier | 270/52.18 X |
| 5,350,268 | 9/1994 | Muller | 270/52.18 X |
| 5,356,125 | 10/1994 | Hansch et al. | 270/53 |
| 5,417,410 | 5/1995 | Meier | 270/52.18 |
| 5,464,199 | 11/1995 | Stauber | 270/52.18 |

FOREIGN PATENT DOCUMENTS

| | | |
|---|---|---|
| 2011479 | 3/1990 | Canada . |
| 0390733 | 10/1990 | European Pat. Off. . |
| 0390734 | 10/1990 | European Pat. Off. . |
| 2491392 | 4/1982 | France . |
| 3616566 | 12/1986 | Germany . |
| 641113 | 2/1984 | Switzerland . |
| 1305485 | 1/1973 | United Kingdom . |
| 21355132 | 5/1974 | United Kingdom . |
| 2072631 | 10/1981 | United Kingdom . |
| 2106033 | 4/1983 | United Kingdom . |
| WO79/00839 | 10/1979 | WIPO . |

OTHER PUBLICATIONS

Xerox Disclosure Journal, "Binding Apparatus", Acquiviva, Thomas, vol. 1, No. 1, Jan. 1976.

*Primary Examiner*—John E. Ryznic
*Attorney, Agent, or Firm*—Brinks Hofer Gilson & Lione

[57] ABSTRACT

A device for stitching printed products wherein the circulating path of the supports runs through a stitching region. The supports are parallel and extend at right angles to the circulating direction. The printed products are stitched together by means of the adhesive stitching arrangement during passage through the stitching region. The printed products are deposited astride on the supports. A number of stitching heads circulate along the closed movement path, meet together with the supports in the stitching region and move along with the latter in a section. Penetrating tools of the stitching heads, are used to produce passages in the region of the fold of the printed products. Adhesive is transferred to the sheets of the printed products over the whole length of the passages to produce point-like adhesive stitching.

12 Claims, 4 Drawing Sheets

DEVICE FOR THE ADHESIVE STITCHING OF PRINTED PRODUCTS

BACKGROUND OF INVENTION

The present invention relates to a device for the stitching of folded printed products having a plurality of sheets.

A device of this type is disclosed, for example, in U.S. Pat. No. 5,172,897 and the corresponding EP-A-0399 317. The disclosed device has circulating saddle-shaped supports for printed products along a closed circulating path running through a stitching region. At least during passage through the stitching region, the supports are arranged parallel to one another and extend at right angles to their circulating direction. In addition, the device has a stitching arrangement which includes a number of stitching heads which move along a closed movement path at the speed of movement of the supports. The spacing between the stitching heads essentially corresponds to the spacing between the supports. In the stitching region, the movement path runs parallel to the circulating path of the supports. Thus, in a section of the stitching region, a stitching head meets with each support and runs along together with the support. In this section, the stitching head sets a wire staple, which it has shaped from a section of wire accepted from a wire section dispenser, into the back of the corresponding printed product which is lying on the support. The end sections of the two flanks of the wire staple which extend beyond the printed product are bent by bending elements which are arranged in the supports. Thus, wire stitching which holds together the sheets of the printed product is produced. Wire stitchings of this kind are useful but a large quantity of wire is needed. If printed products with only a few sheets as well as products with many sheets are to be processed with this type of device, it is necessary to design the stitching arrangement such that various wire thicknesses and wire section lengths can be processed.

It is therefore one object of the present invention to provide a device which enables reliable stitching together of printed products without wire, with a high processing capacity, and with a simple construction.

SUMMARY OF THE INVENTION

These and other objects are achieved by the new stitching device where the sheets of the printed products are connected to one another by point-like adhesive stitching. The device includes a plurality of saddle-shaped supports on which the printed products circulate along a closed circulating path. The circulating path runs through a stitching region. In a section of the stitching region, a plurality of stitching heads from a stitching arrangement run along with the supports. The stitching heads have penetrating tools which form passages through the printed products in the region of the fold of the printed products. The stitching arrangement has an adhesive feeder device which feeds adhesive to the penetrating tools. The penetrating tools transfer the adhesive to the sheets in the passages to thereby produce adhesive stitching.

Since the stitching heads circulate along a closed movement path in one direction, quiet operation is ensured even in the case of a high processing speed. The transfer of the adhesive onto the sheets can be carried out at the time of generating the passages and/or during withdrawal of the penetrating tool, this advantageously occurring by wiping off.

With the present invention, printed products of different thicknesses can be processed without problems, without changes to parts of the stitching arrangement having to be undertaken. If necessary, the quantity of adhesive fed to the penetrating tools has to be matched to the thickness of the printed products.

In a preferred embodiment, the stitching head has a plurality of penetrating tools so that a printed product can be simultaneously stitched at a plurality of locations.

BRIEF DESCRIPTION OF THE DRAWINGS

The present invention is now be explained in more detail using an exemplary embodiment shown in the drawings which are in purely schematic form.

DETAILED DESCRIPTION OF THE PREFERRED EMBODIMENT

Figure 1:
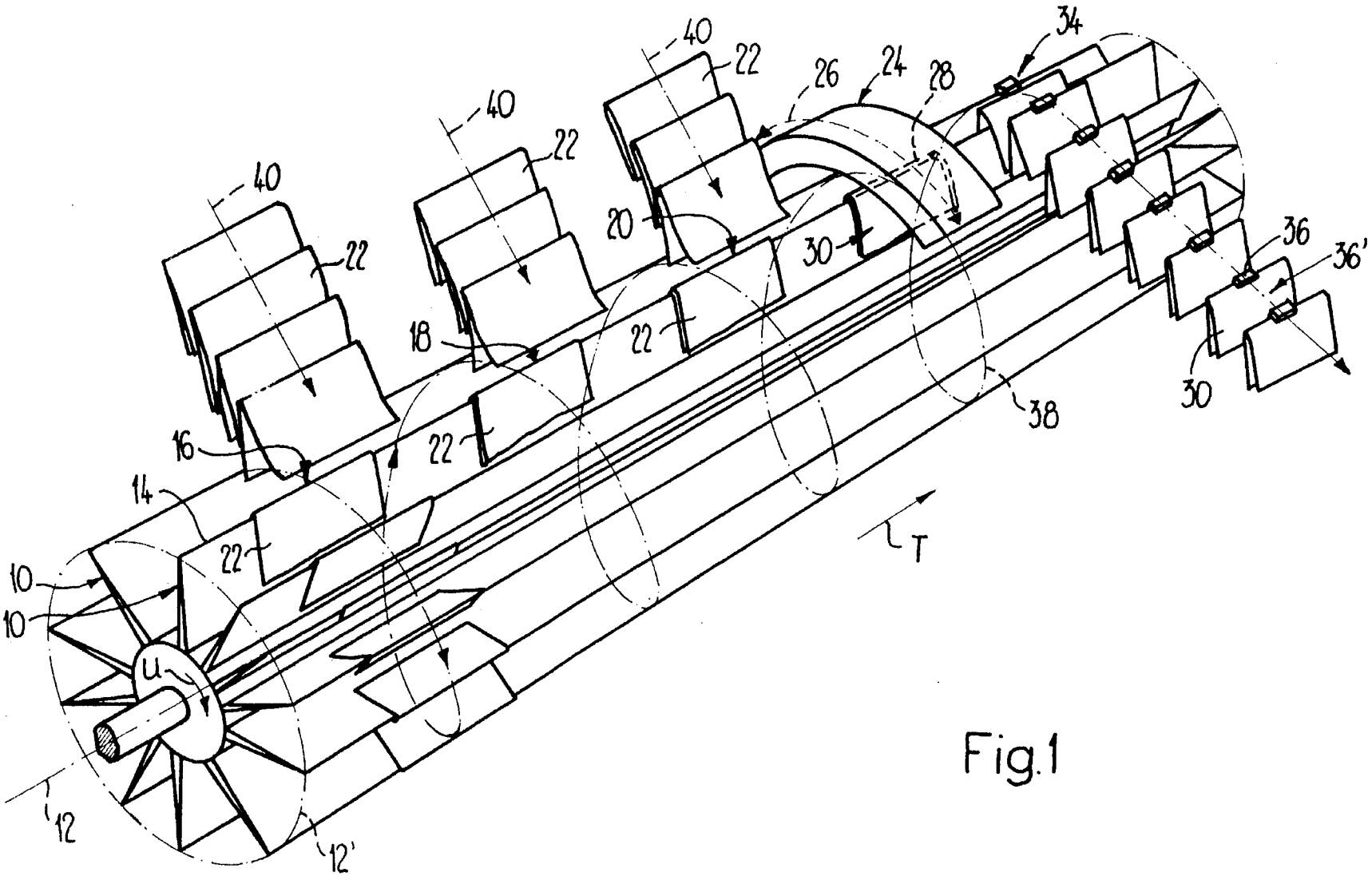
FIG. 1 shows in a perspective view, very simplified, a preferred embodiment of a device for collecting sheets and the subsequent adhesive stitching of the printed products formed from the sheets.

Referring now to the drawings, FIG. 1 shows a multiplicity of collecting tracks 10 which are arranged in drum fashion about a common axis of rotation 12. The collecting tracks 10 run horizontally and rotate in the direction of the arrow U. Each collecting track 10 has a saddle-shaped support 14 lying radially on the outside, and running parallel to the axis of circulation 12. Thus, the saddle-shaped supports run at right angles to the circulating path 12'. By way of example, in the illustrated case folded printed sheets 22 can be deposited astride on the support 14 at three feed locations 16, 18, 20 (arranged one behind the other in the axial direction). Seen in the transport direction T, an adhesive stitching arrangement 24, which extends over a stapling region 26 seen in the circulating direction U, is arranged downstream of the feed locations 16, 18, 20. The adhesive stitching arrangement 24 produces, in the region of the fold 28 of the printed products 30 (formed from the collected printed sheets 22), in each case a number of adhesive stitches which hold the printed sheets 22 together. A method and a device for producing point-like adhesive stitching is disclosed in the earlier Swiss Patent Application No. 01 754/93-7, to which correspond European Patent Application No. 94 107 767.9 and U.S. patent application Ser. No. 08/258,096 which are incorporated herein by reference. Here, one possible construction of the stitching heads and of the supports and their mode of operation is shown. In addition (seen in the transport direction T) a conveying location 34 is positioned downstream of the adhesive stitching arrangement 24. At this location, the stitched printed products 30 are raised from the collecting tracks 10 and transported away.

Allocated to each collecting track 10 is a transport mechanism comprised of a plurality of transport devices (not shown in FIG. 1 for the sake of clarity) which transport the printed sheets 22 or printed products 30 stepwise in the transport direction T as the collecting tracks 10 revolve around the axis of circulation 12. The transport devices are controlled in such a way that they are inactive for transport when the respective collecting track 10 is passing through the stitching region 26. As a consequence, the printed products 30 stand still (seen in the direction of the axis of circulation 12) during their passage through the stitching region 26 and move in the circulating direction U in this region on a sector of a circular path. The feed locations 16, 18, 20 and the conveying location 34 (seen in the circulating direction U) are also arranged inside the stitching region 26. Thus, the transport devices also stand still in the direction of the axis of circulation 12 during the deposition of the printed sheets 22 on the supports 14 (or on printed sheets 22 which have already been deposited on the supports 14) as well as during seizing of the stitched printed products 30 at the conveying location 34 by grippers 36 of the conveyer 36'.

In the course of one revolution around the axis of circulation 12 but outside the stitching region 26, the transport devices respectively make one stroke in the transport direction T. In this manner, the printed sheets 22 which have been deposited on the supports 14 are transported from one feed location 16, 18, 20 to the next feed location 18, 20 or to the adhesive stitching arrangement 24 and to the conveying location 34. The printed sheets 22 are thus transported along a partially helical and partially circular path 38, shown with a dash-dotted line.

In a preferred embodiment, the printed sheets 22 to be processed are fed to the feed locations 16, 18, 20 by gripper conveyors 40 of the type generally known in the art. Here, the printed sheets 22 are opened and allowed to fall astride the supports 14. With respect to the construction and the mode of operation of devices having collecting tracks 10 arranged in drum fashion, the gripper conveyors 40 and the conveyor 36', and the transport devices for the transport of the printed sheets 22 or printed products 30 along the supports 14, reference is expressly made to U.S. Pat. Nos. 5,052,667 and 5,324,014 and the corresponding 0 341 425 and 0 550 828 which are incorporated herein by reference.

Figure 2:
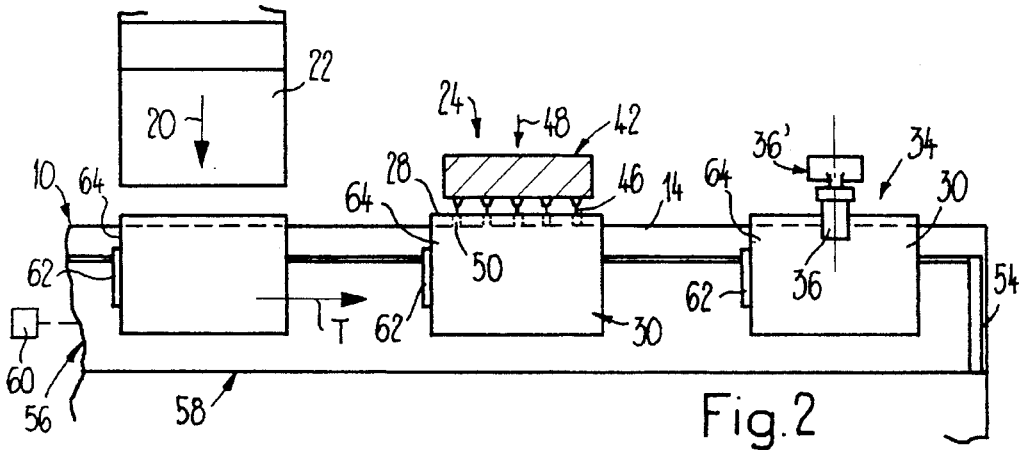
FIG. 2 shows a view of a part of a collecting track of the device with the stitching arrangement.
Figure 3:
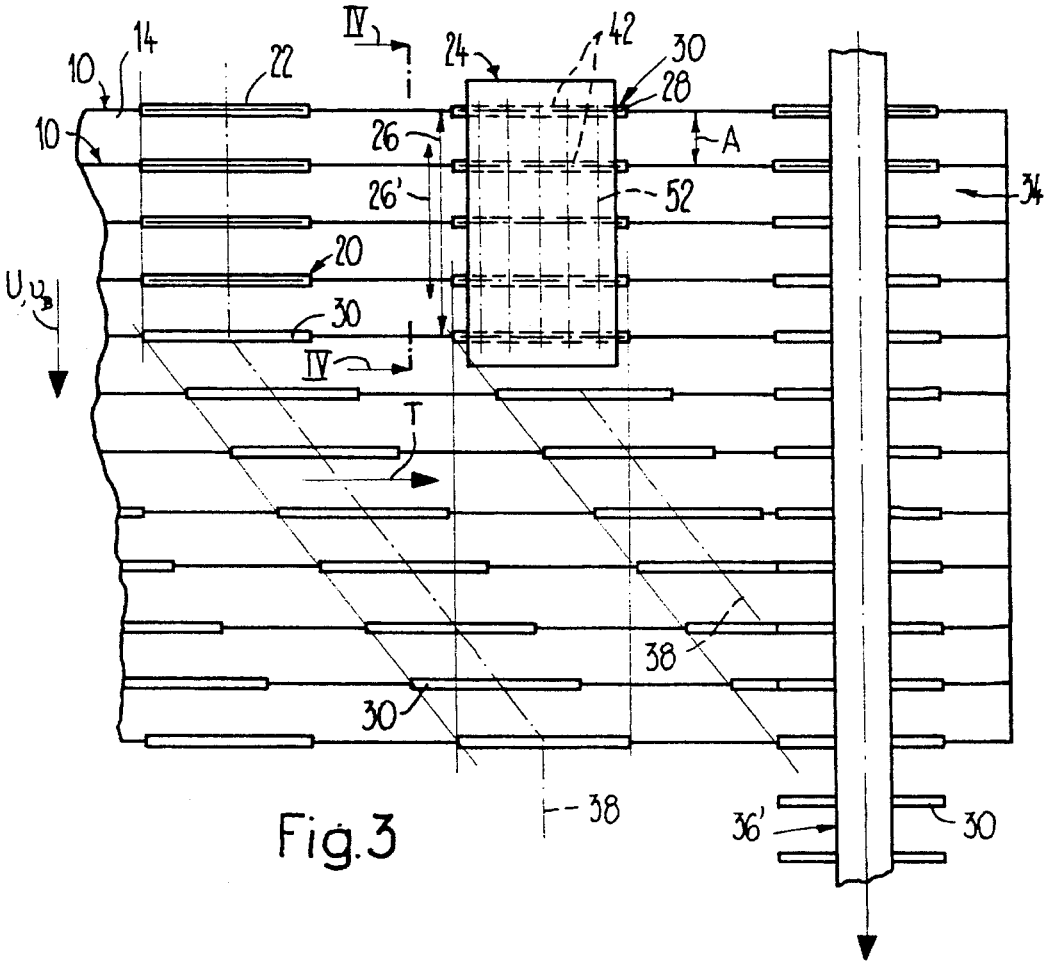
FIG. 3 shows a development of one part of the device shown in FIG. 1.

As seen in FIGS. 2 and 3, the adhesive stitching arrangement 24 has a number of stitching heads 42 which are arranged one after the other at the spacing A of the supports 14. The stitching heads circulate along a closed movement path 44 (see FIG. 4) with a circulation speed $v_u$, which essentially corresponds to the speed of movement $v_B$ of the supports 14. In the stitching region 26, one stitching head 42 meets with a support 14 and runs along with the latter in a section 26' of the stitching region 26. Each stitching head 42 has at least one, but preferably a plurality of penetrating tools 46. During the passage through the section 26', the penetrating tools 46 are brought from a rest position (in which they are spaced apart from the support 14 and from the printed product 30 to be stitched) in the direction of the arrow 48 into a penetrating position. In the penetrating position, the penetrating tools 46 generate passages 50 through the relevant printed product 30 and are brought once more into the rest position counter to the direction of the arrow 48. In FIG. 3, the circulating paths of the penetrating tools 46 are shown with dash-dotted lines 52. It can also be seen from FIG. 3 that the transport of the printed sheets 22 or printed products 30 in the longitudinal direction of the supports 14 is carried out outside the stitching region 26 (see the path 38 shown dash-dotted).

As FIG. 2 shows, the support 14 of each collecting track 10 is arranged on the radially outer end of a wall 54 which runs parallel to the axis of circulation 12 and radially with respect to the latter. The transport devices 56 transport the printed sheets 22 or printed products 30 in the direction of arrow T in a stepwise manner. The transport devices 56 have, per collecting track 10, a carriage 58. The carriage 58 is supported on the relevant wall 54 and capable of being displaced in and against the direction of the arrow T. The carriage 58 is connected to a drive 60 (schematically shown). The drive 60 may be for example a connecting-link drive. Dogs 62 project from the carriages 58 and strike the printed sheets 22 and printed products 30 on the trailing edge 64 during one operating stroke in the direction of the arrow T. On the return stroke they travel underneath the printed sheets 22 or printed products 30. Transport devices 56 of this type are described in detail in U.S. Pat. No. 5,324,014 and the corresponding EP A 0 550 014 which are incorporated herein by reference.

Figure 4:
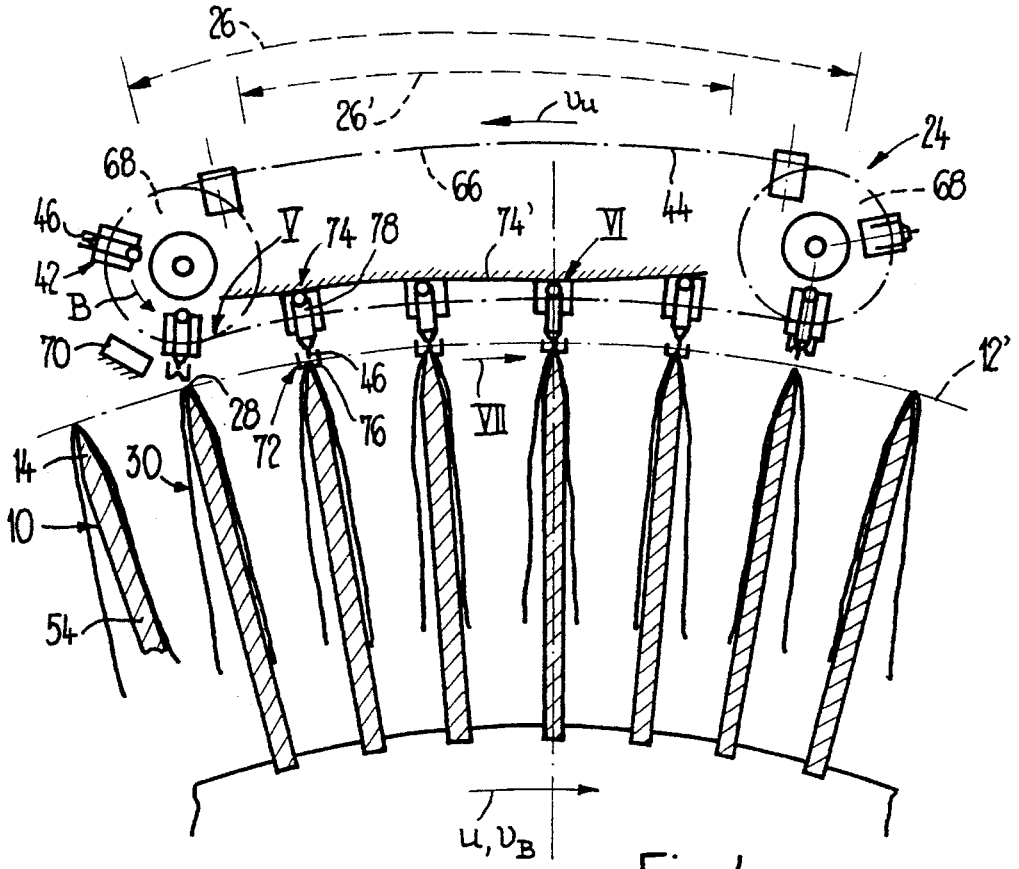
FIG. 4 shows a section through the device according to FIG. 1 along the line IV—IV of FIG. 3.

As follows from FIG. 4, the stitching heads 42 are arranged on an endless traction element 66, shown dash-dotted. The endless traction element may be for example a chain or a pair of chains. At the beginning and at the end of the stitching region 26, the traction element 66 is guided around deflection wheels 68. In addition, at the deflection wheel 68 at the beginning of the stitching region 26, there is arranged an adhesive feeder device 70. In each case during the passage of a stitching head 42, the adhesive feeder device 70 applies a specific quantity of adhesive to its penetrating tool 46. The adhesive may be applied for example by wiping off, brushing on or spraying on.

Each stitching head 42 has a pressing device 72 which can be lowered in the stitching region 26 by a connecting-link drive 74 onto the printed product 30 to be stitched in order to press the latter against the support 14. The pressing device 72 has V-shaped cut-out centering elements 76 which engage around the printed product 30 and the support 14. Thus, the stitching head 42 is centered with respect to the support 14 at the same time as the printed product 30 is pressed on. As the printed products 30 are pressed on, a device 78 for driving the penetrating tools 46 forward and drawing them back is actuated via the connecting-link drive 74, in order to produce the passages 50 and to transfer the adhesive over their entire length to the printed sheets 22, in order to produce a point-like adhesive stitching. Before each stitching head 42 reaches the deflection wheel 68 at the end of the stitching region 26, it is lifted off from the now stitched printed product 30 under the control of the connecting-link drive 74.

Figure 5:
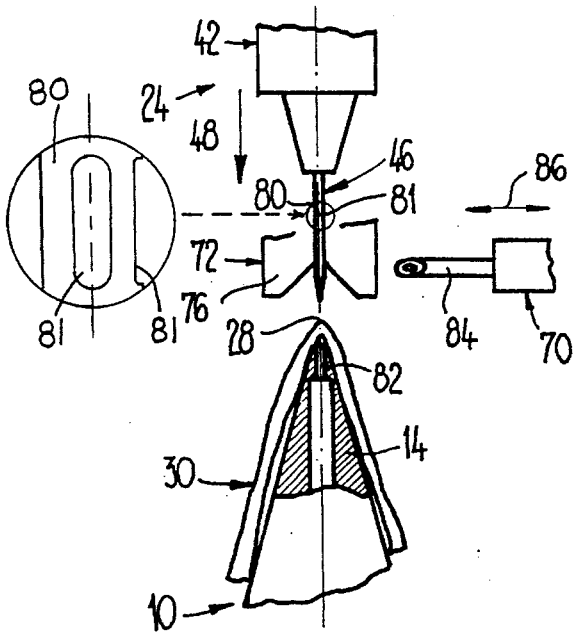
FIG. 5 shows, partly in section, a stitching head and a support at location V of FIG. 4.
Figure 6:
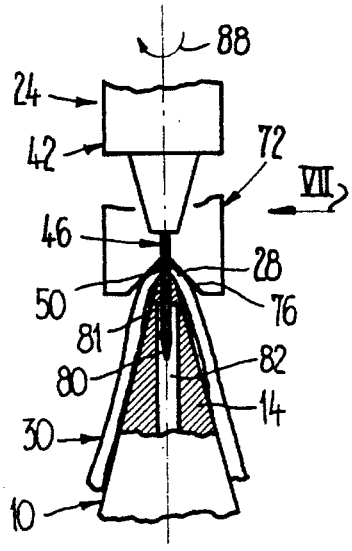
FIG. 6 shows, in the same representation as FIG. 5, a stitching head and a support at location VI of FIG. 4.

FIGS. 5 and 6 show, partially in section, a support 14 with the printed product 30 arranged thereupon astride and a stitching head 42 located in the rest position and the penetrating position respectively. In the example shown, the penetrating tools 46 are formed by boring needles 80. The needles 80 have a closed point and pickups 81, such as flutes or grooves on the outer side picking up an adhesive and transferring the latter to the walls of the passages 50.

With respect to the possible construction of penetrating tools 46 and to the transfer of the adhesive to the walls and the passages 50, reference is expressly made to U.S. patent application Ser. No. 08/258,096 and corresponding Swiss Patent Application No. 01 754/93-7, are European Patent Application No. 94 107 767.9 which are incorporated herein by reference.

The supports 14 have cutouts 82, preferably passages round in cross section, into which the penetrating tools 46 can penetrate with a clearance when brought into the penetrating position, as is shown in FIG. 6.

In addition, in FIG. 5, an adhesive application tube 84 of the adhesive feeder device 70 is shown. As each stitching head 42 passes, this tube can be positioned into and withdrawn from the movement path 52 of the relevant boring needle 80 in the direction of the double arrow 86 in order to apply adhesive to the boring needle.

Each stitching head 42 has two centering elements 76 per penetrating tool 46. The penetrating tool 46 is arranged between the centering elements in each case. Since the centering elements 76 (seen in the longitudinal direction of the supports 14) are spaced from one another, they press the printed product 30 onto the support 14 outside the cutout 82. It should be noted that only one centering element 76 is shown in each case in FIGS. 5 and 6. As is shown with the arrow 80, the boring needle 88 is driven in rotation about its axis during lowering from the rest position, into the penetrating position. It is also conceivable to use, instead of boring needles 80, drive-in needles, which do not then have to be driven in the direction of the arrow 88. During withdrawal into the rest position the boring needles 80 can be driven further in the direction of arrow 88 or in the opposite direction or not driven.

Figure 7:
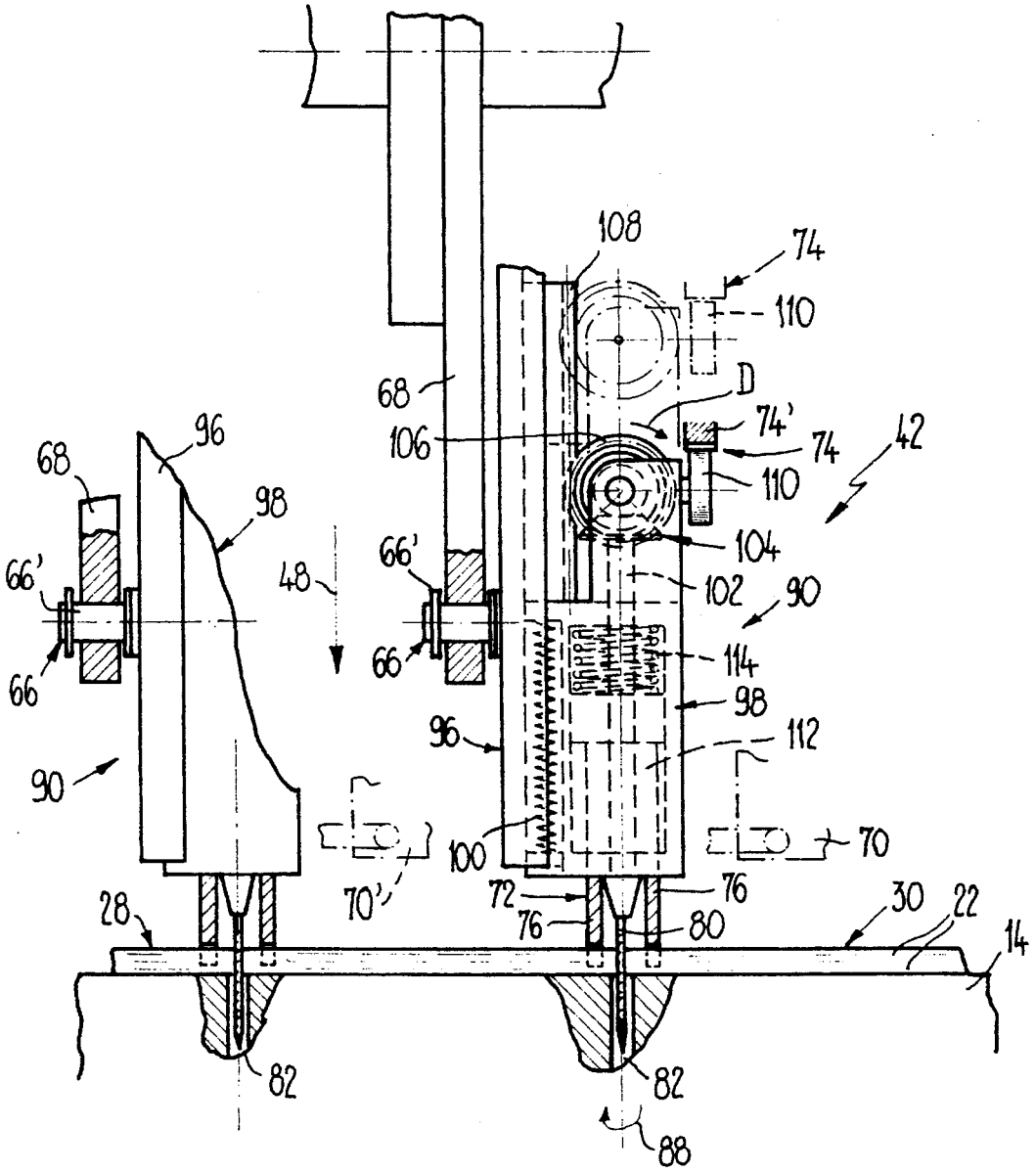
FIG. 7 shows a view of FIG. 6 in the direction of the arrow VII.

FIG. 7 shows one embodiment of the stitching head 42 having two stitching units 90 arranged alongside one another. A stitching head 42 can have still more stitching units 90. Two parallel chains 66' of the traction element 66, spaced from one another, (FIG. 4) are guided around deflection wheels 68 (chain wheels) supported on the same axis. Arranged on each chain 66', approximately at the spacing of the supports 14, there are rail-like guiding elements 96 of the stitching units 90. The longitudinal direction of the guiding elements 96 runs essentially at right angles to their movement path 44. A slide 98 is in each case guided in the guiding element 96 so as to be displaceable in and against the direction of the arrow 48. A first compression spring 100 acts between the guiding element 96 and the slide 98 in order to force the slide 98 into the rest position (shown dash-dotted) against the direction of the arrow 48.

A boring spindle 102 is mounted rotatably on the slide 98 and carries a boring needle 80 on its end facing the support 14. At the other end, the boring spindle 102 is connected via a bevel wheel transmission 104 to a spur wheel 106, which interacts with a rack 108 on the guiding element 96.

In addition, a following roller 110 of the connecting-link drive 74 is supported freely rotatably on the slide 98 and interacts with the fixed connecting link 74'. As can be seen overall in conjunction with FIG. 4, as it revolves in the direction of the arrow B the slide 98 is displaced by the connecting link 74' in the direction of the arrow 48 from the rest position into the penetrating position (shown with bold lines in FIG. 7). In so doing, the spur wheel 106 is driven in the direction of arrow D. This rotation is converted via the bevel wheel transmission 104 into a rotation of the boring needle 80 in the direction of the arrow 88. During the backward movement of the slide 98 out of the penetrating position into the rest position, driven by the compression spring 100 and controlled by the connecting link 74', the boring needle 80 is consequently rotated in the opposite direction.

The two centering elements 76 of the pressing device 72 are supported in a cutout 112 of the slide 98 so as to be displaceable in the direction of the boring spindle 102. A second compression spring 114 acts between the centering elements 76 and the slide 98 to force the centering elements 76 into an extended position relative to the slide 98 in which they assume the position shown in FIG. 5 with reference to the boring needle 80. As the slide 98 moves from the rest position into the penetrating position, the centering elements 76 come to rest on the printed product 30 to be stitched and press the printed product 30 against the support 14 under the force of the second compression spring 114. With this arrangement, the supports 14 are also centered with respect to the stitching units 90. As the slide 98 is further lowered in the direction of the penetrating position, the centering elements 76 are now held back against the force of the second compression spring 114 and the boring needle 80 is forced through the back 28 of the fold of the printed product 30 to produce a passage 50. In so doing, the adhesive previously fed by the adhesive feeder device 70 to the boring needle 80 is transferred to the printed sheets 22 over the whole length of the passage 50. In the penetrating position, the free end region of the boring needle 80 engages with a clearance in the cutout 82 of the supports 14. With this arrangement, adhesive is prevented from being deposited on the support 14.

During the backward movement of the slide 98 from the penetrating position into the rest position, the boring needle 80 is withdrawn, while the centering elements 76 remain resting on the printed product 30 under the force of the second compression spring 114, until the boring needle 80 has left the passage 50 produced and the centering elements 76 are taken along by the slide 98, for example by means of a stop.

In the exemplary embodiment shown above, the supports 14 run along a circular circulating path 12' around the axis of circulation 12. However, it is also conceivable that the supports 14 are moved along an extended circulating path, as is shown, for example, in U.S. Pat. No. 5,292,110 and the corresponding EP-A-0 510 525. An adhesive stitching arrangement 24 according to the present invention can take the place of the stitching apparatus shown there.

In addition, the invention also contemplates embodiments in which the printed sheets or printed products are not displaced in the longitudinal direction of the supports. See for example U.S. Pat. Nos. 4,489,930 and 5,104,108 or the corresponding EP-A-0 095 603 and EP-A-0 346 578.

In all embodiments, the supports 14 extend essentially parallel and at right angles to their circulating direction.

With the preferred embodiment of the device according to the invention, wherein the supports 14 have cutouts 82, it is ensured in a simple way that printed products of different thicknesses can be stitched without undertaking adjustment operations.

The embodiment described above with the pressing devices enables reliable holding of the printed products during the adhesive stitching by cooperating with the supports. This leads to qualitatively good adhesive stitching and prevents damage to or displacement of sheets within the printed products.

The embodiment with the centering elements 76 enables exceptionally accurate stitching with a simple construction.

The embodiment wherein the stitching heads 42 have a driving device 78 enables the production of the passages at any location in the section of the stitching region, independent of the meeting of the stitching heads with the supports.

Adhesive stitching of qualitatively particularly high standing can be achieved with the embodiment wherein the pressing device 72 presses the printed products 30 against the supports 14 before the driving device 78 drives the penetrating tool 46 into the printed products 30 and removes pressure only after the penetrating tool 46 has been withdrawn.

The embodiment wherein the penetrating tools have boring needles 80 with a closed point and pickups 81 ensures long service lives of the penetrating tools.

The embodiment wherein the stitching heads 42 are arranged on an endless tractions element 66 enables a simple construction of the stitching arrangement, independent of the form of the circulating path.

The embodiment with the control means 74 provides a reliable interaction of the stitching heads and supports is ensured in a simple way, independent of the form of the circulating path.

The embodiment wherein the supports 14 are disposed on a rotatable processing drum requires little space and has a high processing capacity.

It is naturally also conceivable to use blade-like penetrating tools which are not rotated during driving forward. It is also conceivable to provide channels in the penetrating tools in order to carry the adhesive through into the passages through the penetrating tool.

The foregoing description of the preferred embodiments of the present invention has been presented for purposes of illustration and description. The preferred embodiments are not intended to be exhaustive or to limit the invention to the precise forms disclosed, and obviously many modifications and variations are possible in light of the above teachings. It is intended that the scope of the invention be defined by the following claims, including all equivalents.

I claim:

1. A device for stitching folded printed products having a plurality of sheets, the device comprising:

a plurality of saddle-shaped supports for the printed products circulating along a closed circulating path running through a stitching region, the printed products being arranged astride the supports and parallel to one another when running through the stitching region and extending essentially at right angles to their circulating direction (U), a stitching arrangement having a plurality of stitching heads which meet with the supports in the stitching region and run along with the supports in a section of the stitching region, the stitching heads moving along a closed movement path at essentially the speed of movement ($v_B$) of the supports and being arranged one behind the other in the direction of movement (B) at a spacing which corresponds to the spacing between adjacent supports;

each stitching heads having a plurality of penetrating tools for forming passages through the printed products in the region of the fold; and the stitching arrangement having an adhesive feeder device which is separated from the stitching heads and which feeds adhesive to the penetrating tools, the penetrating tools transferring the adhesive onto the sheets in the passages to produce adhesive stitching.

2. The device as claimed in claim 1, wherein the supports have cutouts in which the penetrating tools engage with a clearance after penetrating the printed products.

3. A device for stitching folded printed products having a plurality of sheets, the device comprising:

a plurality of saddle-shaped supports for the printed products circulating along a closed circulating path running through a stitching region, the printed products being arranged astride the supports and parallel to one another when running through the stitching region and extending essentially at right angles to their circulating direction (U), a stitching arrangement having a plurality of stitching heads which meet with the supports in the stitching region and run along with the supports in a section of the stitching region, the stitching heads moving along a closed movement path at essentially the speed of movement ($v_B$) of the supports and being arranged one behind the other in the direction of movement (B) at a spacing which corresponds to the spacing between adjacent supports;

each stitching heads having a plurality of penetrating tools for forming passages through the printed products in the region of the fold;

the stitching arrangement having an adhesive feeder device which is separated from the stitching heads and which feeds adhesive to the penetrating tools, the penetrating tools transferring the adhesive onto the sheets in the passages to produce adhesive stitching; and wherein the penetrating tools have boring needles having a closed point and pickups on the outer side for picking up the adhesive and transferring the latter to the walls of the passages.

4. The device as claimed in claim 3 wherein the pickups comprise grooves.

5. A device for stitching folded printed products having a plurality of sheets, the device comprising:

a plurality of saddle-shaped supports for the printed products circulating along a closed circulating path running through a stitching region, the printed products being arranged astride the supports and parallel to one another when running through the stitching region and extending essentially at right angles to their circulating direction (U), a stitching arrangement having a plurality of stitching heads which meet with the supports in the stitching region and run along with the supports in a section of the stitching region, the stitching heads moving along a closed movement path at essentially the speed of movement ($v_B$) of the supports and being arranged one behind the other in the direction of movement (B) at a spacing which corresponds to the spacing between adjacent supports;

each stitching heads having a plurality of penetrating tools for forming passages through the printed products in the region of the fold;

the stitching arrangement having an adhesive feeder device which is separated from the stitching heads and which feeds adhesive to the penetrating tools, the penetrating tools transferring the adhesive onto the sheets in the passages to produce adhesive stitching; and wherein the stitching arrangement comprises pressing devices which press the printed products against the supports during driving in or pulling out of the penetrating tools.

6. The device as claimed in claim 5, wherein each stitching head comprises a pressing device having centering elements which engage around the respective supports to press the printed product onto the support and at the same time center the stitching head and the support with respect to one another.

7. The device as claimed in claim 6, wherein the stitching heads have a driving device for driving the penetrating tools forward and pulling them back.

8. The device as claimed in claim 6, wherein the pressing device in each case presses the printed product against the support before a driving device drives the penetrating tools into the printed product and removes the pressure again only after the penetrating tools have been withdrawn.

9. The device as claimed in claim 7, wherein a pressing device in each case presses the printed product against the support before the driving device drives the penetrating tools into the printed product and removes the pressure again only after the penetrating tools have been withdrawn.

10. The device as claimed in claim 5, wherein the stitching heads are arranged on an endless traction element that is guided around deflection wheels at the start and end of said stitching region.

11. The device as claimed in claim 10, wherein control means are arranged between said deflection wheels to press the stitching heads and the pressing devices in the direction against the supports and, if necessary, to drive the device for driving the penetrating tools forward and pulling them back.

12. The device as claimed in claim 5, comprising:

a processing drum driven in rotation about its horizontal axis of rotation, the supports arranged on the processing drum parallel to the axis of rotation;

feed devices arranged one after the other in the direction of the axis of rotation, the feed devices feeding and depositing the sheets astride the supports or on sheets already deposited on the latter;

a transport mechanism to transport the sheets deposited on the supports stepwise in the course of the revolutions of the processing drum from one feed device to the next and to the stitching arrangement, the transport being inactive for transport during passage through the stitching region;

a conveyor for conveying away the adhesively-stitched printed products.

* * * * *